US007291243B2

(12) United States Patent
Adami

(10) Patent No.: US 7,291,243 B2
(45) Date of Patent: Nov. 6, 2007

(54) DEVICE FOR JOINING SHEETS OF CARDBOARD TO FORM CORRUGATED CARDBOARD

(75) Inventor: Mauro Adami, Lucca (IT)

(73) Assignee: Fosber S.p.A. (IT)

( * ) Notice: Subject to any disclaimer, the term of this patent is extended or adjusted under 35 U.S.C. 154(b) by 557 days.

(21) Appl. No.: 10/867,464

(22) Filed: Jun. 14, 2004

(65) Prior Publication Data

US 2004/0261950 A1 Dec. 30, 2004

(30) Foreign Application Priority Data

Jun. 27, 2003 (EP) ..... 03425422

(51) Int. Cl.
*B30B 15/34* (2006.01)

(52) U.S. Cl. ..... 156/583.8; 156/583.91; 156/583.1

(58) Field of Classification Search ..... None
See application file for complete search history.

(56) References Cited

U.S. PATENT DOCUMENTS

| | | | | |
|---|---|---|---|---|
| 3,527,638 | A | 9/1970 | Sonnichsen | |
| 3,753,838 | A * | 8/1973 | Brandenburg | 156/555 |
| 5,005,473 | A | 4/1991 | Ishibashi | |
| 5,256,240 | A | 10/1993 | Shortt | |
| 5,415,720 | A | 5/1995 | Schönhammer et al. | |
| 5,456,783 | A | 10/1995 | Sissons | |
| 5,466,329 | A | 11/1995 | Marschke | |
| 5,526,739 | A | 6/1996 | Lauderbaugh et al. | |
| 5,539,997 | A | 7/1996 | Teschner | |
| 5,561,918 | A | 10/1996 | Marschke | |
| 5,628,865 | A | 5/1997 | Marschke | |
| 5,732,622 | A * | 3/1998 | Lauderbaugh | 100/306 |
| 5,746,010 | A | 5/1998 | Marschke et al. | |
| 5,785,802 | A | 7/1998 | Seki et al. | |
| 5,832,628 | A | 11/1998 | Marschke | |
| 5,836,241 | A | 11/1998 | Horton | |
| 5,837,974 | A | 11/1998 | Sissons et al. | |
| 5,853,527 | A | 12/1998 | Marschke et al. | |
| 5,910,230 | A | 6/1999 | Seki et al. | |
| 5,915,295 | A * | 6/1999 | Lauderbaugh | 100/38 |
| 5,993,587 | A | 11/1999 | Seki et al. | |

(Continued)

FOREIGN PATENT DOCUMENTS

| | | |
|---|---|---|
| EP | 0 409 510 | 1/1991 |

(Continued)

OTHER PUBLICATIONS

U.S. Appl. No. 09/056,537, filed Apr. 8, 1998, Chuzles et al.

*Primary Examiner*—Richard Crispino
*Assistant Examiner*—Barbara J. Musser
(74) *Attorney, Agent, or Firm*—McGlew and Tuttle, P.C.

(57) ABSTRACT

The device to join a sheet of smooth cardboard (N4) to a sheet of corrugated cardboard (N1; N2; N3), comprises a series of heated plates (3) aligned according to a longitudinal direction of feed (F) of the cardboard and, above said heated plates, pressure elements (53) to press the cardboard against said heated plates, which are fastened by elastic elements to a supporting structure (41). The supporting structure comprises a plurality of frames (41) aligned according to the longitudinal direction (F) and the inclination of the frames is adjustable to modify the pressure profile applied by said pressure elements to the cardboard (C).

43 Claims, 9 Drawing Sheets

U.S. PATENT DOCUMENTS

| | | | |
|---|---|---|---|
| 6,074,520 | A | 6/2000 | Marschke et al. |
| 6,189,445 | B1 | 2/2001 | Knorr et al. |

FOREIGN PATENT DOCUMENTS

| | | |
|---|---|---|
| EP | 0 623 459 | 11/1994 |
| EP | 0 648 599 | 4/1995 |
| EP | 0 750 986 | 1/1997 |
| EP | 0 819 054 | 1/1998 |
| EP | 0 839 642 | 5/1998 |
| EP | 0 862 989 | 9/1998 |
| EP | 0 943 423 | 9/1999 |
| EP | 0 949 064 | 10/1999 |
| EP | 0 949 065 | 10/1999 |
| EP | 1 101 599 | 5/2001 |
| WO | WO99/24249 | 5/1999 |

* cited by examiner

DEVICE FOR JOINING SHEETS OF CARDBOARD TO FORM CORRUGATED CARDBOARD

TECHNICAL FIELD

The present invention relates to a device to produce corrugated cardboard. In more detail, the present invention relates to so-called "double facer" device, used in the field of corrugated cardboard production to join by gluing a sheet of smooth cardboard to a sheet of corrugated cardboard, constituted by two or more layers.

BACKGROUND OF THE INVENTION

Corrugated cardboard is constituted by a multi-layer web product, constituted by at least a smooth layer joined by gluing to a corrugated layer. The smooth layer is usually called "liner". Normally, the corrugated cardboard has at least two liners, between which and to which at least one corrugated layer is enclosed and glued. The structure of the cardboard may also be more complex, when greater thickness is required. For example, smooth and corrugated layers may be alternated. In this case, the two external layers are constituted by liners, that is they are smooth layers, between which corrugated layers separated by smooth layers are distributed alternately.

Webs of smooth cardboard are used to produce this type of product. In a first machine, called "single facer", corrugation of a first smooth layer or web is performed by a pair of corrugating cylinders. The corrugated web is joined to a smooth web or liner after applying a glue to the flutes produced on the corrugated web. Examples of machines of this type are described in U.S. Pat. No. 3,527,638; U.S. Pat. No. 5,628,865; U.S. Pat. No. 5,785,802; U.S. Pat. No. 5,415,720.

Joining a multi-layer semi-finished product, constituted by at least a smooth liner and a corrugated layer, to another smooth layer is obtained in machines or devices called "double facers". Examples of these machines are described in EP-B-0.648.599; EP-A-0.949.064; EP-A-0.949.065; U.S. Pat. No. 5,526,739; U.S. Pat. No. 6,189,445; U.S. Pat. No. 5,837,974; U.S. Pat. No. 5,456,783; U.S. Pat. No. 5,466,329; U.S. Pat. Nos. 5,256,240; 5,005,473; WO-A-9924249; EP-A-0.750.986; EP-A-1.101.599; EP-A-0.839.642; EP-A-0.862.989; EP-A-0.819.054; U.S. Pat. No. 5,836,241; EP-B-0.409.510; U.S. Pat. No. 5,466,329; U.S. Pat. No. 5,561,918.

These devices are constituted, briefly, by a series of heated surfaces or plates, over which the cardboard travels. More precisely, a smooth sheet or "liner" is fed to the device and is glued to a semi-finished product constituted in turn by a smooth sheet previously glued to a corrugated sheet. Several semi-finished products constituted by a smooth sheet and by a corrugated sheet glued together may be fed simultaneously to the device to produce cardboard with several corrugated layers. Previously, glue is applied to the flute tips of the corrugated sheet or layer that is brought into contact with the liner. The cardboard constituted by several layers is then pressed against the heated plates by a series of pressure elements. A flexible pulling element, such as a belt or mat may be provided between these pressure elements and the cardboard.

In "double facer" devices of older conception, the pressure elements were constituted by rollers arranged in series along the longitudinal direction of feed of the cardboard, with their axes of rotation orthogonal to the direction of feed. This type of device had the serious drawback of not allowing even pressure on the cardboard, as the rollers do not adapt to the deformations of the underlying hot plates, which become deformed due to thermal dilations. This results in uneven gluing of the layers of corrugated cardboard produced.

To overcome these drawbacks devices have been produced wherein the rollers are replaced by pressure elements of different arrangement. U.S. Pat. No. 5,456,783 and EP-B-0.623.459 describe a pressure device comprising a series of transverse beams, connected to which are pressure elements or pressure shoes, elastically stressed against the underlying cardboard and fastened to the transverse beams by levers that limit movements in space.

EP-B-0943.423 and U.S. Pat. No. 6,189,445 describe a system similar to the previous one, wherein the pressure elements or shoes, however, are fastened to the transverse beams by a mobile support and springs that allow increased mobility of the shoes. The support rests on the shoes through the springs.

Systems wherein the pressure is exerted by liquid-filled bags or vessels, resting on plates which in turn rest directly on the cardboard have also been devised (see EP-B-0.409.510).

The object of all these systems is to adapt the pressure elements to the deformations of the underlying heated plates.

A further critical aspect in the production of corrugated cardboard is constituted by the possibility of modifying the pressure profile along the direction of feed of the cardboard. For this purpose, devices have been produced with adjustment actuators, distributed along the full length of the pressure system. An example of device of this type is described in U.S. Pat. No. 5,466,329. This type of solutions is particularly complex and costly, also as it is necessary to provide a high number of actuators.

EP-A-0.750.986, U.S. Pat. No. 5,746,010, U.S. Pat. No. 5,853,527 and U.S. Pat. No. 5,832,628 describe a device wherein the pressure on the cardboard is applied by a sort of mat hung at its ends so that the position in space can be adjusted by lifting one of the two ends. In this way the contact surface between the pressure belt and the underlying cardboard is reduced. Nonetheless, the solution offers limited advantages, as this device only allows to increase or decrease the active length of the device, that is the length along which there is pressure between the cardboard and underlying hot plates. On the contrary, it is not possible to modulate and adjust the pressure profile.

"Double facer" devices have a useful width determined by the width of the hot plates, that is by the transverse extension of these plates, orthogonal to the longitudinal direction of cardboard feed, as well as by the width on which the pressure elements act. Corrugated cardboard is produced even in very small batches, differing from one another in the type of material, number of layers and also in width. This means that in many circumstances the device processes cardboard the width of which is below the maximum operating width. When this occurs, there is greater wear on the pressure elements. In fact, in the side bands, where there is no cardboard, these press directly on the underlying hot plates or against the belt or mat disposed between the pressure elements and the cardboard. In this case, the edge areas of the belt (at the level of which there is no cardboard) rub directly on the hot plates and are subject to extremely high thermal stress.

In addition to the problem of wear, direct pressure contact between the belt and hot plates prevents normal lateral release of the humidity contained in the glue, with consequent difficulties in gluing.

OBJECTS AND SUMMARY OF THE INVENTION

The object of the present invention is to produce a so-called "double facer" device to produce corrugated cardboard, which overcomes entirely or in part the limits of traditional devices.

In greater detail, according to a first aspect, the object of the present invention is to produce a device that makes it possible to obtain optimal adjustment of the pressure profile, that is of the pressure trend along the longitudinal direction of feed of the cardboard.

These and other objects and advantages, which shall become apparent to those skilled in the art by reading the text hereunder, are obtained essentially with a device to join a sheet of smooth cardboard to a sheet of corrugated cardboard, comprising a series of heated plates aligned according to a longitudinal direction of feed of the cardboard and, above said heated plates, pressure elements to press the cardboard against said heated plates, which are connected by elastic elements to a supporting structure, wherein the supporting structure comprises a plurality of frames aligned according to the longitudinal direction, the inclination of which in relation to the horizontal is adjustable to modify the pressure trend applied by the pressure elements to the cardboard along a longitudinal direction of feed.

With this arrangement the first important advantage of being able to adjust the pressure profile in an extremely versatile manner in the direction of movement of the cardboard is obtained. In fact, each frame may be positioned with its own inclination, so that the pressure of the various pressure elements, carried by the single frame, may vary in an essentially linear way, thanks to gradual variation in the compression of the elastic elements, constituted for example by compression springs. In principle, each frame may be hinged to a fixed point, while its opposite end is mobile in an approximately vertical direction, to adjust inclination of the frame. Nonetheless, according to a preferred embodiment of the invention, both ends of the frame are vertically mobile. This makes it possible to obtain greater flexibility in the distribution of pressures along the direction of feed of the cardboard. For this purpose each end of the frame may be equipped with at least one raising and lowering actuator. By adjusting the height of the end of the frame in respect of the surface defined by the underlying heated plates, this increases or decreases the pressure exerted by the underlying pressure elements through greater or lesser compression of the elastic elements.

According to a preferred embodiment of the invention, the frames are hinged to one another. In this case, in the hinge points a single actuator is provided to act on two successive frames.

Each frame may advantageously be constituted by a pair of transverse end beams, joined to each other by a structure that extends longitudinally, i.e. approximately parallel to the direction of advance of the cardboard. This structure may be constituted by one or more longitudinal beams fastened to the transverse beams to form the frame. The pressure elements may in this case be fastened to the longitudinal beams.

According to a different aspect, the object of an improved embodiment of the present invention is to provide a device that makes it possible to reduce problems of wear and/or other problems related to the processing of corrugated cardboards of different widths, below the maximum operating width of the device.

For this purpose each frame may support on each side at least a longitudinal beam mobile in respect of the frame to be lifted in respect of the frame carrying it and therefore in respect of the underlying heated plates. If the frame is constituted by longitudinal beams fastened to transverse beams, the mobile longitudinal beams are disposed outside in respect of the longitudinal beams forming the fixed part of the frame, which will thus be disposed in a central position. Preferably more than one mobile side beam (and preferably three side beams) are provided on each side of each frame. Alternatively, all the longitudinal beams extending between the two transverse beams of each frame may be mobile in respect of said frame and the transverse beams may be joined to each other by a separate connection structure extending longitudinally, for example by one or more auxiliary beams that are positioned above the mobile longitudinal beams, or intercalated between them. The pressure elements may in this case be fastened solely to the mobile longitudinal beams. However, in the currently preferred embodiment, the frame has a series of central longitudinal beams connected rigidly to the transverse beams and, on each side a series of mobile longitudinal beams, parallel to the fixed central beams. The pressure elements are fastened to the fixed and mobile longitudinal beams.

As will be explained hereunder with reference to an embodiment of the invention, an arrangement with longitudinal beams carried by the frame and mobile in respect of the frame makes it possible to prevent or in any case reduce drawbacks caused by the variability in the width of the cardboard processed by the device. In fact, one or more of the external mobile longitudinal beams of each frame may be raised in respect of the frame so as to reduce or eliminate pressure applied to the underlying elastic elements, through which the pressure elements are fastened to said beam(s). In this way the pressure elements no longer press against the underlying heated plates, or against the belt when this is provided.

As a rule, the pressure elements may be constituted by a plurality of transversal alignments of single pressure elements, positioned in succession in the longitudinal direction of feed of the cardboard. Nonetheless, according to a particularly advantageous embodiment of the invention, each pressure element extends transversely to the longitudinal direction of feed for the entire operating width of the device, i.e. with a length essentially equivalent to the useful width of the device. It may in this case be fastened by one or more elastic elements to all the beams or in any case to a plurality of longitudinal beams placed side by side, both fixed and mobile in respect of the frame.

Preferably, to obtain even distribution of pressure in the transverse direction, each pressure element will be fastened by means of at least one elastic element to each longitudinal beam. According to a preferred embodiment, several elastic connecting elements (for example three) will be provided between each beam and each pressure element. These may advantageously be constituted by helical compression springs.

The pressure element may advantageously be constituted by a sheet that forms a shoe having at least one flat contact portion with the underlying cardboard or with the underlying belt conveying the cardboard. When the shoe or pressure element is continuous on the entire width of the device, it will advantageously be equipped with openings or slots and if necessary reinforcements to obtain a suitable degree of elasticity and rigidity in the various areas of said shoe. Typically, reinforcement section bars will be provided at the level of the connection points of the elastic elements.

It has been seen above that with an arrangement of longitudinal beams mobile in respect of the frame the advantage is attained of being able to increase or reduce, according to the specific production needs, the width of the area in which the shoe is pressed against the cardboard or the underlying belt, to prevent exerting pressure on the surfaces of the heated plates on which there is no cardboard. It is clear that an adjustment thus obtained is relatively rough, as the width of the active area may be modified in steps equivalent to the distance between two adjacent longitudinal beams.

According to an improved embodiment of the invention, to obtain finer adjustment, the frames may be equipped with an adjustment movement in a transverse direction to the longitudinal direction of feed of the cardboard. In this way the accuracy of adjustment of the width of the active area is increased, as shall be explained in greater detail hereunder.

Further advantageous features and embodiments of the invention are indicated in the appended dependent claims and shall be described in greater detail with reference to one embodiment.

According to another aspect, the object of the present invention is to produce a so-called "double facer" device, comprising a series of heated plates aligned according to a longitudinal direction of feed of the cardboard and, above said heated plates, a supporting structure, to which pressure elements are fastened to press the cardboard against said heated plates, defining a work face of a variable width as a function of the width of the cardboard, wherein adjustment of the width of the work face is more accurate.

To attain this object, the supporting structure is equipped with a traversing movement in a direction essentially orthogonal to the longitudinal direction of feed of the cardboard. In this way the width of the work face, on which the pressure elements exert their action against the underlying heated plates, may be approximated more accurately to the width of the cardboard processed each time by the device. This aspect of the invention may also be applied to devices with different supporting structures and pressure elements than those defined above. In particular, for example, the pressure elements may be fastened to transverse beams, rather than longitudinal beams. Moreover, they may have small dimensions and the overall operating width of the device may be obtained by placing several pressure elements side by side in a transverse direction. In general, the concept of the transverse movement of the load-bearing structure may be applied to each "double facer" device with means to decrease or increase the width of the work face of the device, that is the transverse dimension of the area on which the pressure elements act on the underlying cardboard.

In a preferred embodiment of the invention, however, each pressure element may have a transverse dimension, in an orthogonal direction to the longitudinal direction of feed of the cardboard, equivalent to the maximum transverse dimension of the cardboard and may be fastened in a plurality of points distributed along its transverse dimension to said supporting structure. An elastic element, such as a helical spring, may be provided in the various fastening points. This is compressed when in that area the pressure element is required to exert pressure on the underlying cardboard, and is instead released or elongated when the pressure element does not require to exert any pressure in that area.

The principle of transverse mobility of the load-bearing structure may advantageously be combined with one or more of the features described hereunder.

BRIEF DESCRIPTION OF THE DRAWINGS

The invention shall now be better understood by following the description and appended drawing, which shows a non-limiting practical embodiment of the invention. In the drawing, where equivalent parts are indicated with the same reference number, FIG. 1 schematically shows a side view of the device.

DETAILED DESCRIPTION OF THE PREFERRED EMBODIMENT OF THE INVENTION

Figure 1:
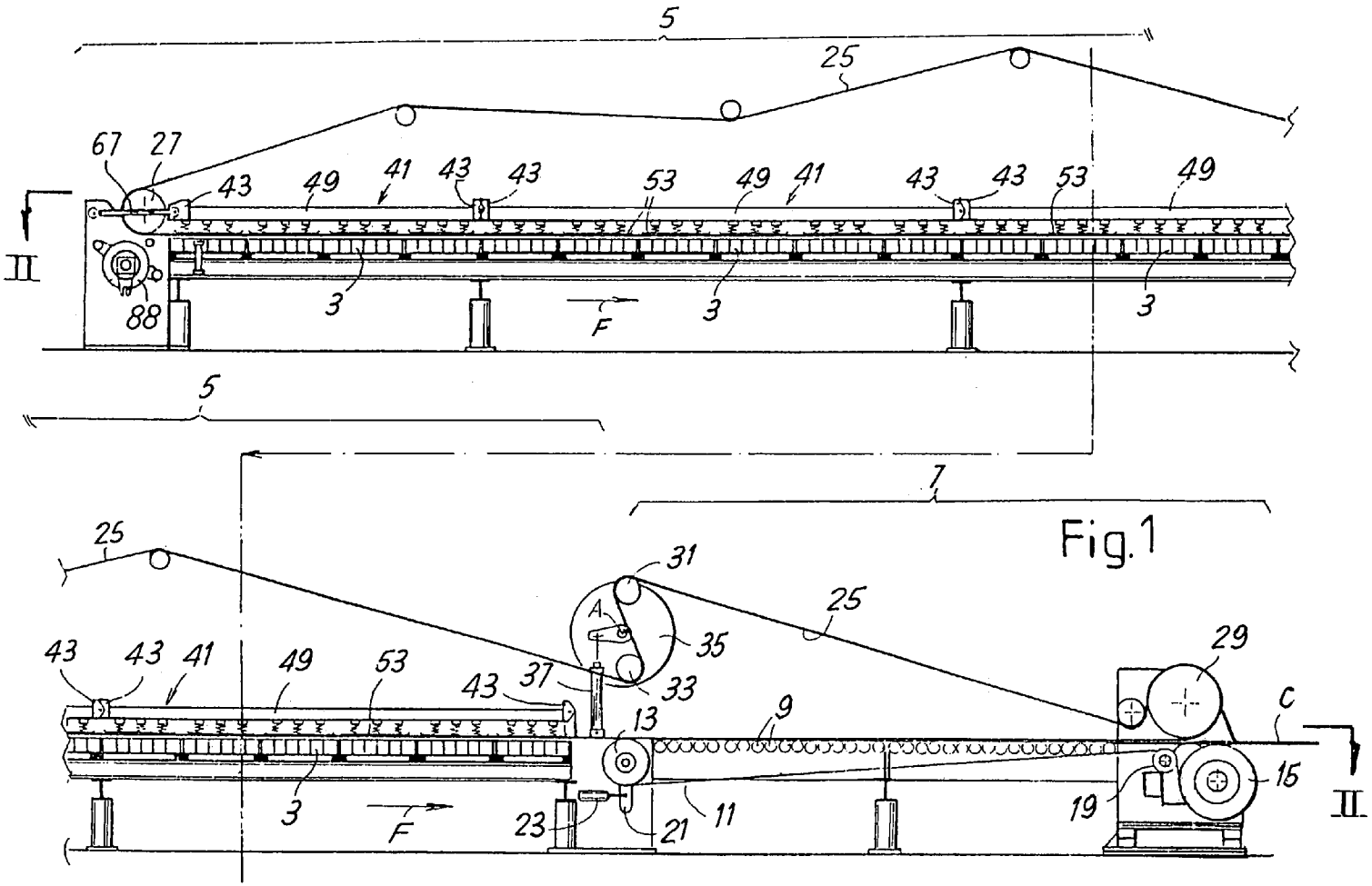
Figure 2:
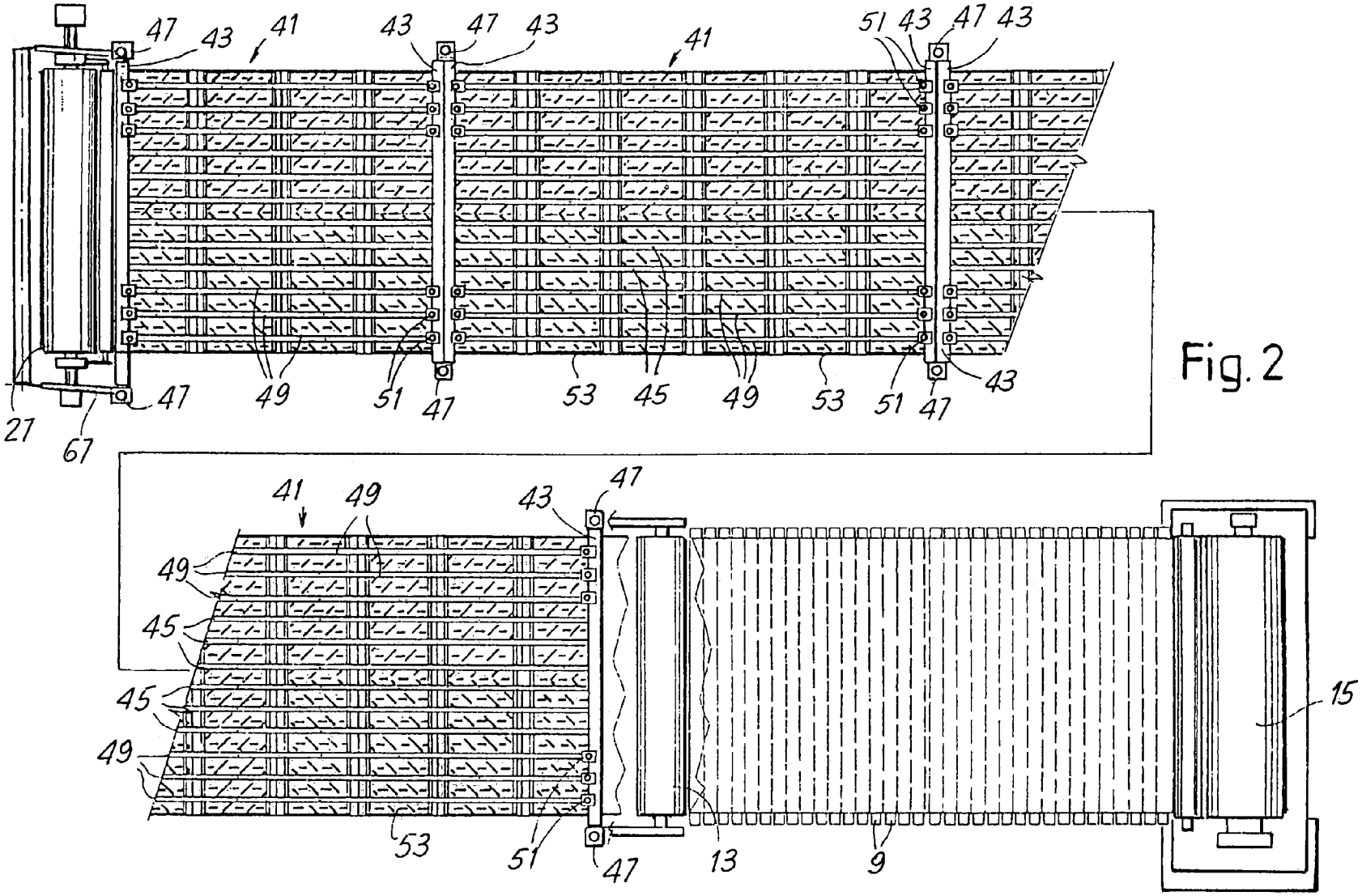
FIG. 2 shows a view according to II-II of the hot section of the device.
Figure 3:
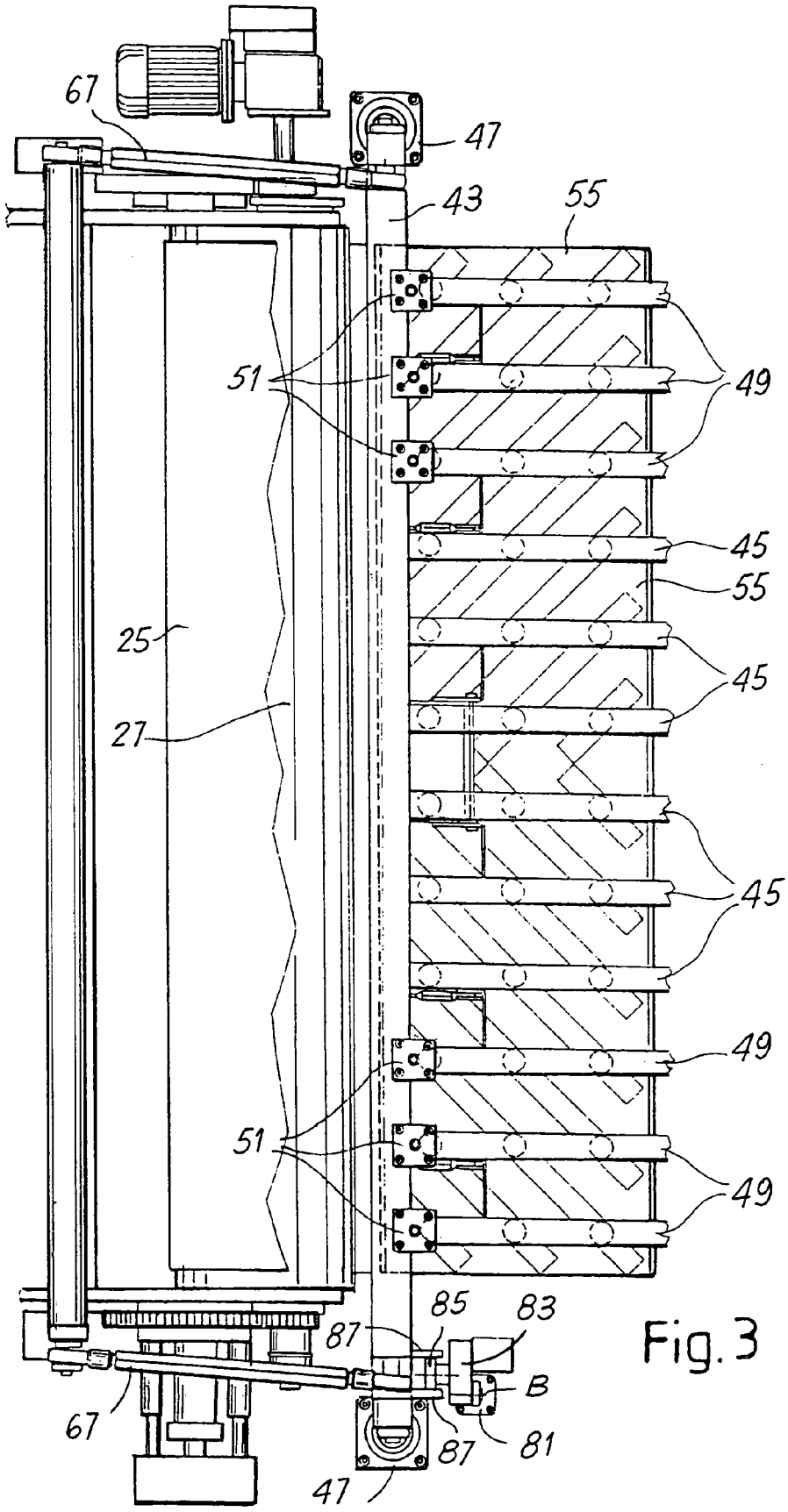
FIG. 3 is an enlarged plan and partial cross-sectional view of the cardboard feed area of the device.
Figure 4:
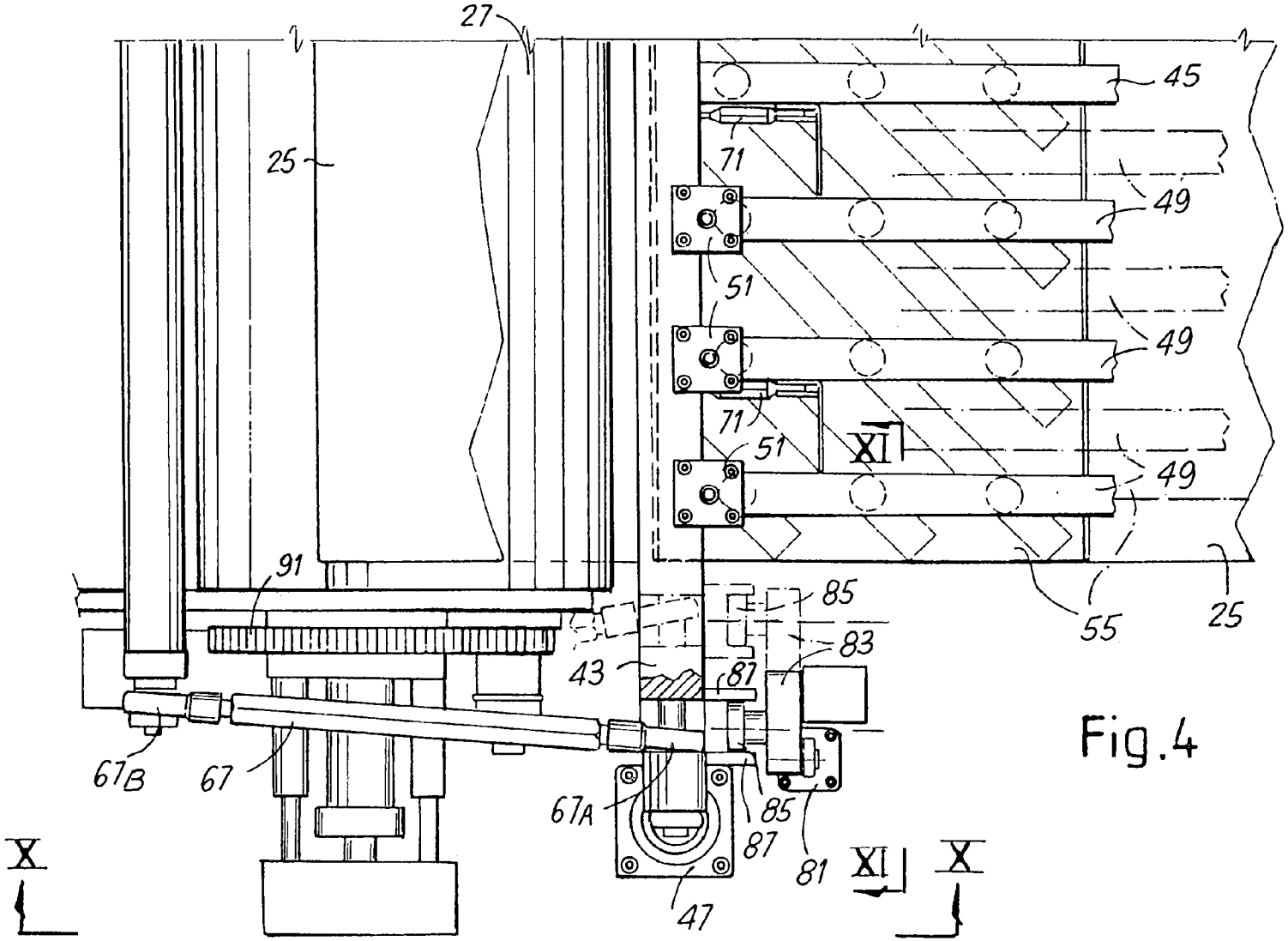
FIG. 4 is an enlarged view of a detail of FIG. 3.

The device as a whole is represented schematically in FIGS. 1 and 2. In each of these figures the processing line is broken into two parts for representation requirements. It has a plurality of heated plates 3, aligned according to a longitudinal direction of cardboard feed, indicated with F. Each heated plate 3 extends transversely to the direction F for the entire useful width of the device. Downstream of the heated plates assembly 3, which form the hot section of the device, indicated with 5, is a conveying section 7, comprising a series of idle rollers 9 disposed more or less at the same level as the upper surface of the heated plates 3. The section 7 also comprises a conveyor belt 11 driven around rollers 13, 15, 19, at least one of which is motorized. The roller 13 is supported by an oscillating arm 21 acted upon by an actuator 23 to tighten the conveyor belt 11.

Extending above the sections 5 and 7 is a conveyor belt 25, driven around two drive rollers at the inlet and outlet of the device, indicated with 27 and 29 respectively. The lower branch of the conveyor belt 25 is parallel to the plane defined by the upper surfaces of the heated plates 3 and to the upper branch of the conveyor belt 11. The upper branch, on the other hand, is driven around a series of guiding rollers and around a pair of tensioning rollers 31, 33, carried by an element 35 revolving around an axis A. Rotation around the axis A is provided by a piston-cylinder actuator 37, which supplies the necessary tension to the conveyor belt 25. The drive roller at the inlet 27 can be raised in respect of the path of the cardboard, that is in respect of the height at which the heated plates 3 are positioned, to allow easier introduction of the sheets or components of the corrugated cardboard at the start of each production cycle.

Figure 10:
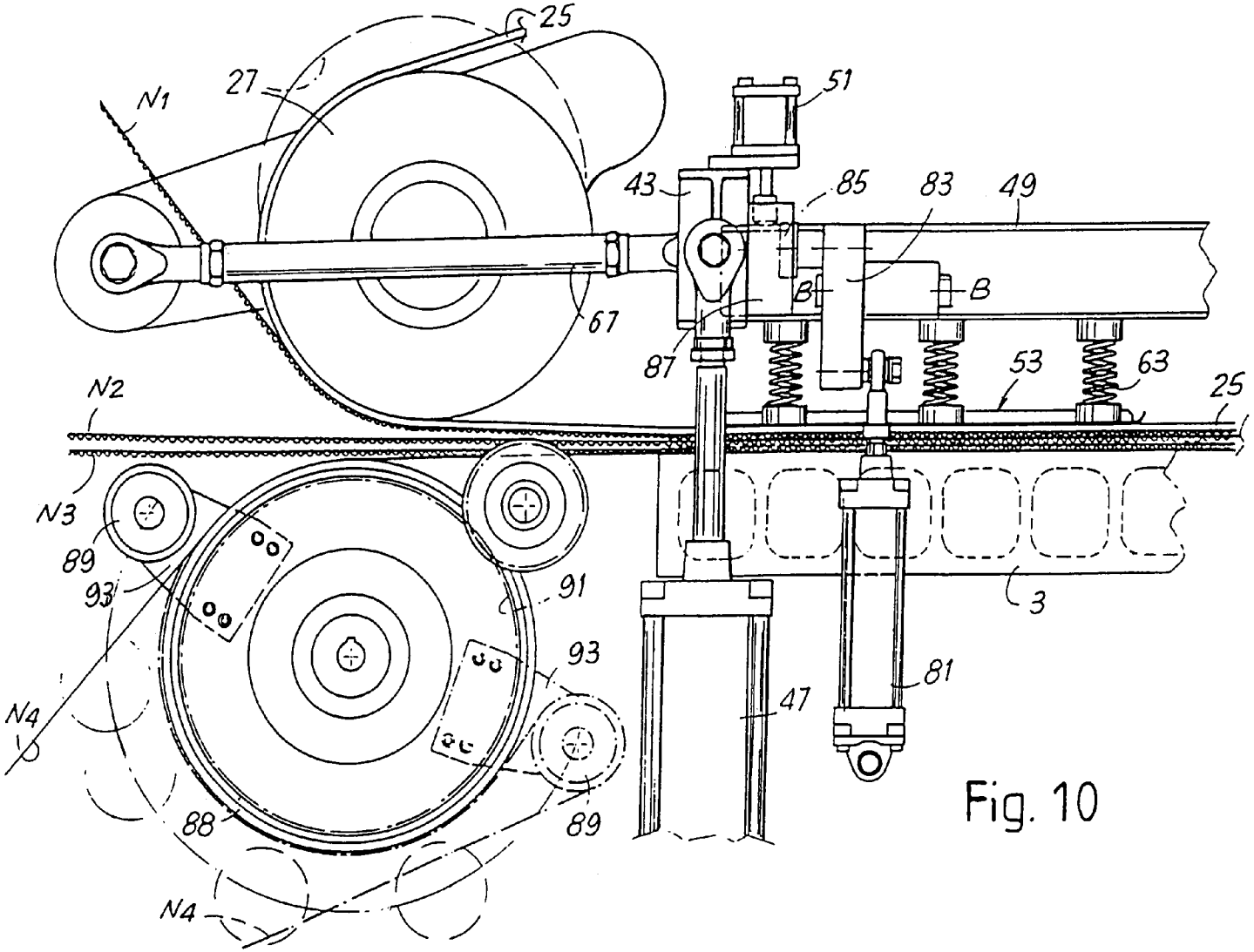
FIG. 10 is an enlarged side view according to X-X in FIG. 4.
Figure 11:
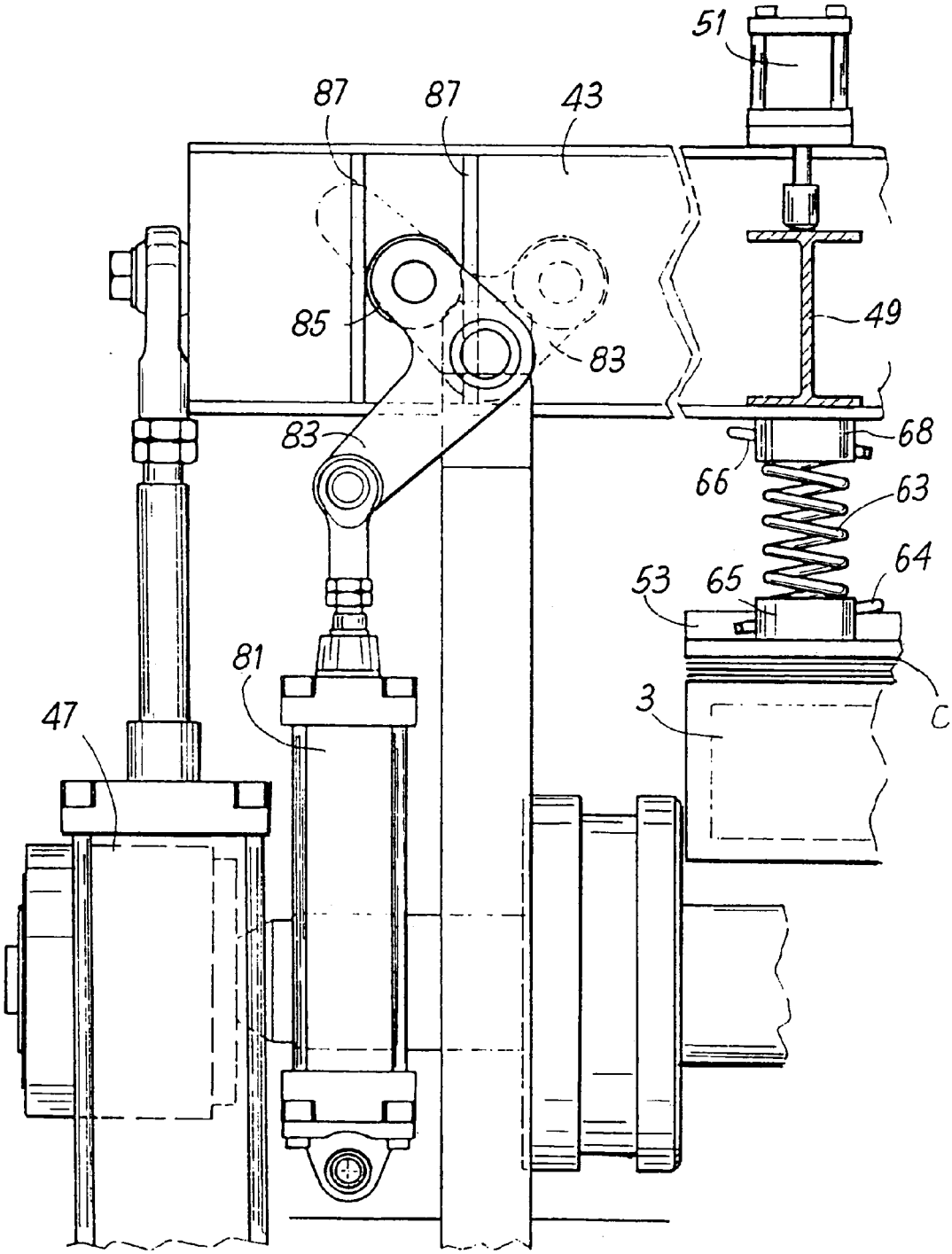
FIG. 11 is an enlarged view according to XI-XI in FIG. 4.

Between the lower branch of the conveyor belt 25 and the upper surface of the heated plates 3, and between the conveyor belt 25 and the conveyor belt 11, a path is defined for the various components to form the corrugated cardboard. These may comprise at least a first component constituted by a simple continuous web or sheet of smooth cardboard, and at least a second component comprising at least a web or sheet of smooth cardboard, previously glued to a web or sheet of corrugated cardboard. More generally, the device may be fed with a plurality of components constituted by a smooth sheet and a corrugated sheet, previously glued to each other, and a smooth sheet or web. In the enlargement of the feed area shown in FIG. 10, the components to form the corrugated cardboard being delivered, indicated with C, are marked with N1, N2, N3, N4, the first three (N1-N3) each being constituted by a smooth sheet previously joined to a corrugated sheet, while the last (N4) is a single smooth sheet.

A glue has been applied to the flute tips of the corrugated sheets of the various components of which the cardboard C is to be formed in order to glue the various components together. For this purpose, as it is not possible to apply high pressure to the components, as this would damage the flutes formed on the corrugated sheets, a relatively low pressure must be applied for an prolonged time, while simultaneously maintaining the glue at a high temperature. The heat to perform this is supplied by the heated plates 3. On the other hand, pressure is applied to the upper surface of the corrugated cardboard by a special arrangement of pressure elements, represented schematically in FIGS. 1 and 2 and in greater detail in the subsequent figures.

A series of frames 41 are disposed along the extension of the hot section 5 of the device, above the heated plates 3. In the example shown three frames 41 are provided, although this number may vary, according to project needs. Each frame 41 comprises two end transverse beams, indicated with 43, rigidly connected to each other by six central longitudinal beams 45. In the example shown, each frame is hinged to the subsequent frame for purposes that will become apparent hereunder. Corresponding piston-cylinder actuators 47, which will control raising and lowering of the frames, are disposed at each end of the transverse beams 43 of the various frames 41. As the frames are hinged to one another, as can be seen in particular in FIG. 2, only one piston-cylinder 47 requires to be disposed at the hinged together ends of the beams 43.

The arrangement described hereinbefore makes it possible to adjust the inclination of each single frame in respect of the longitudinal direction (F) and also, if necessary, in respect of the transverse direction, for the purposes that shall become more apparent hereunder.

Each frame carries, on each side and external to the central longitudinal beams 45, three mobile longitudinal beams 49. Each mobile longitudinal beam 49 is connected at its ends to the respective frame 41 by means of a pair of piston-cylinder actuators 51, which control raising and lowering of these mobile longitudinal beams in respect of the frame.

Figure 5:
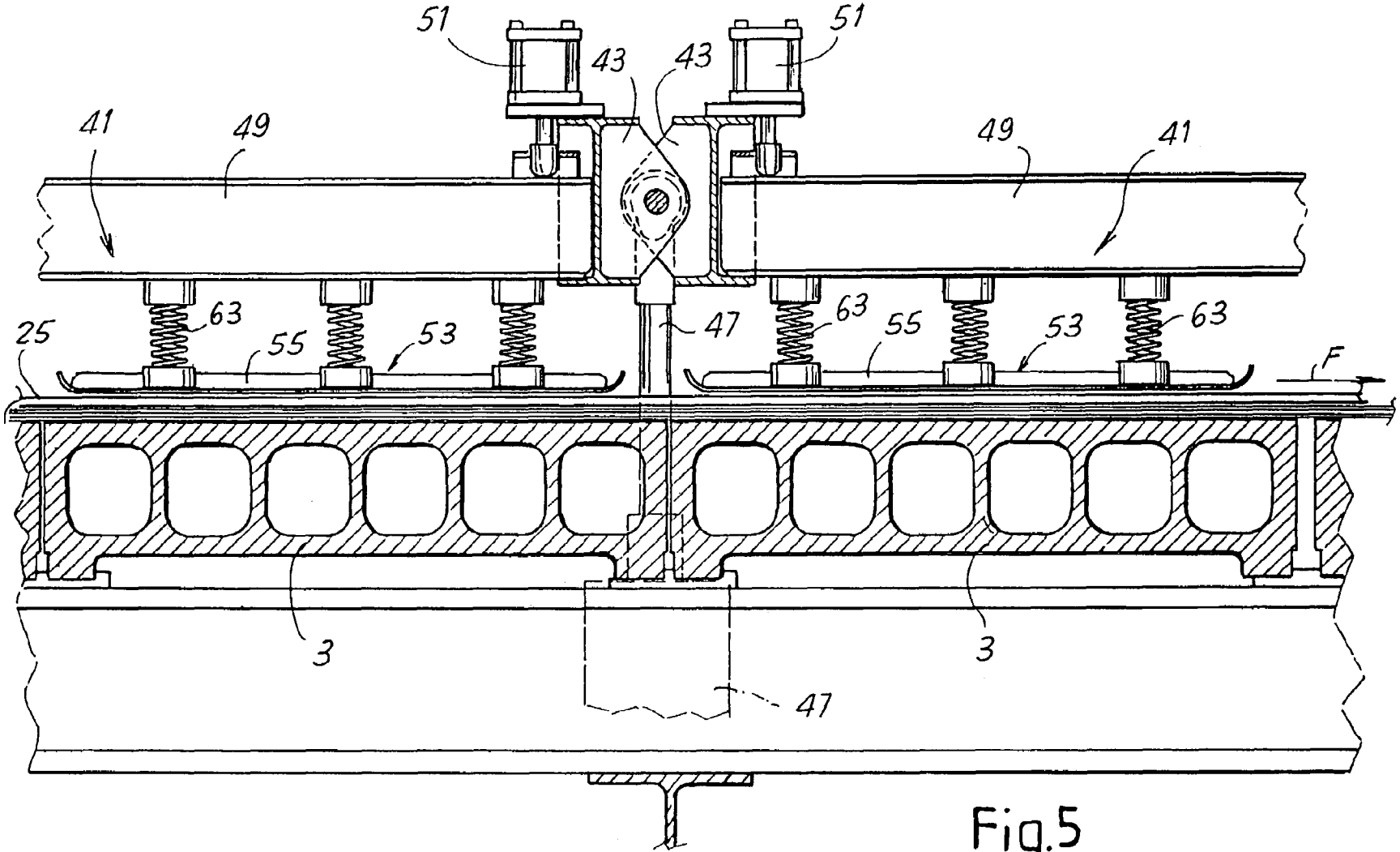
FIG. 5 is a longitudinal cross-section of a connection area between two adjacent frames.
Figure 6:
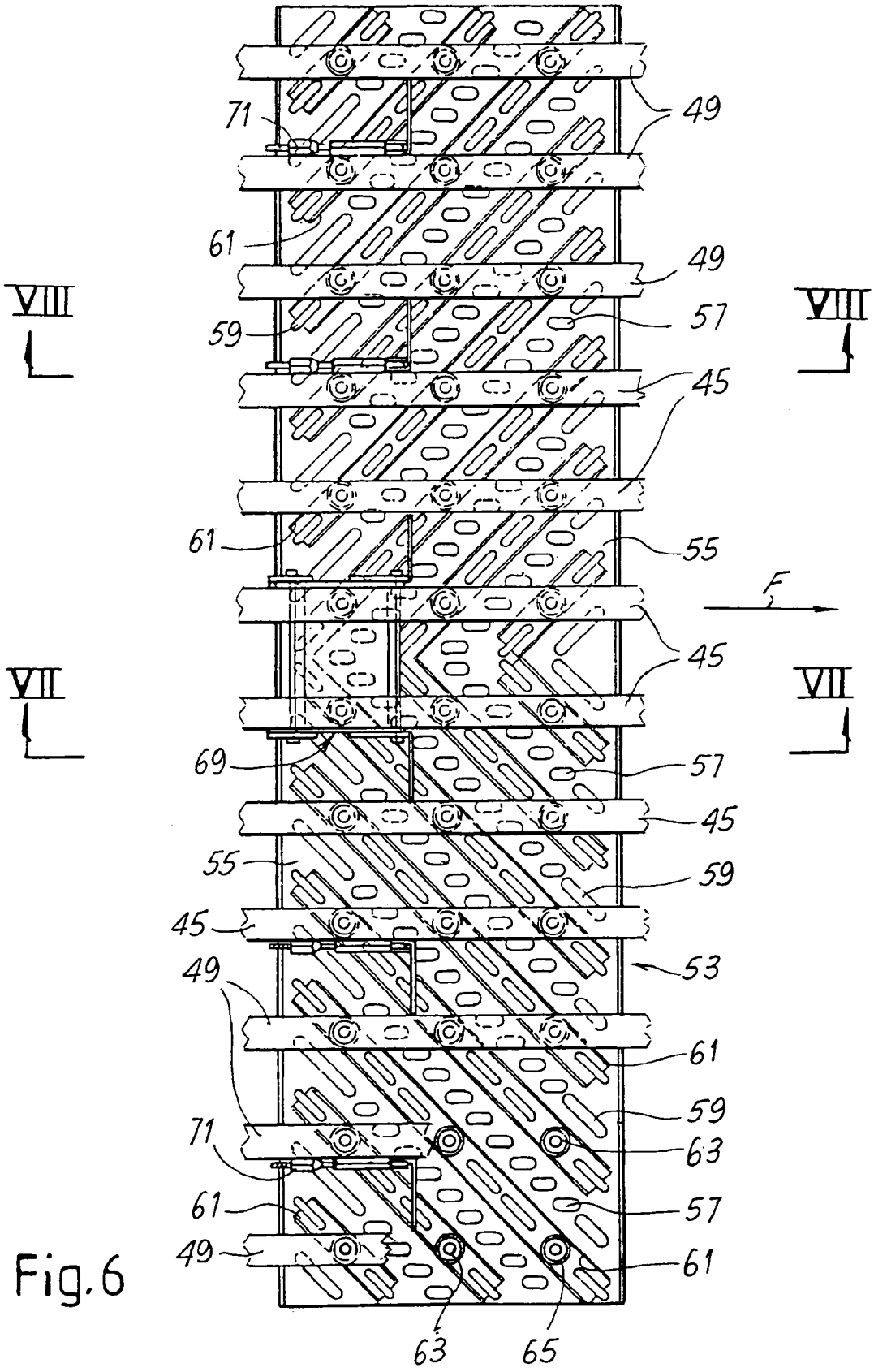
FIG. 6 is a plan view of a pressure shoe or element.
Figure 7:
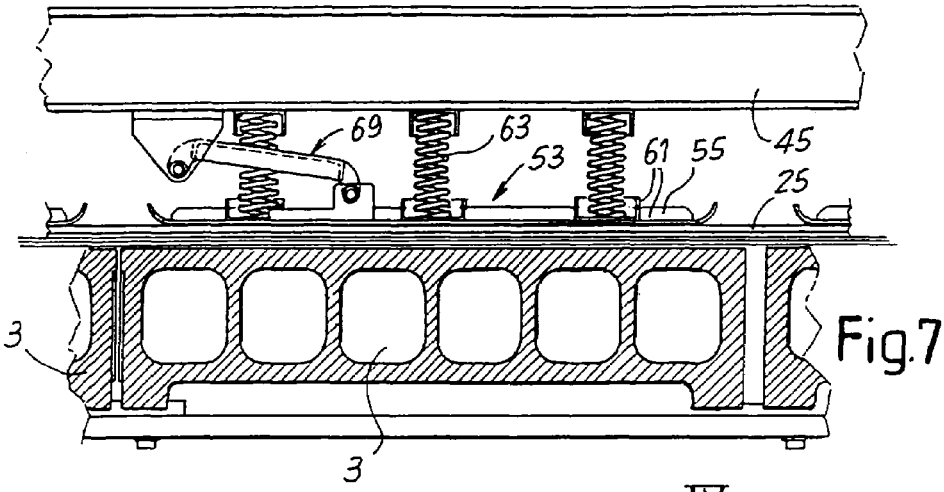
FIGS. 7 and 8 are cross-sections according to VII-VII and VIII-VIII in FIG. 6.
Figure 8:
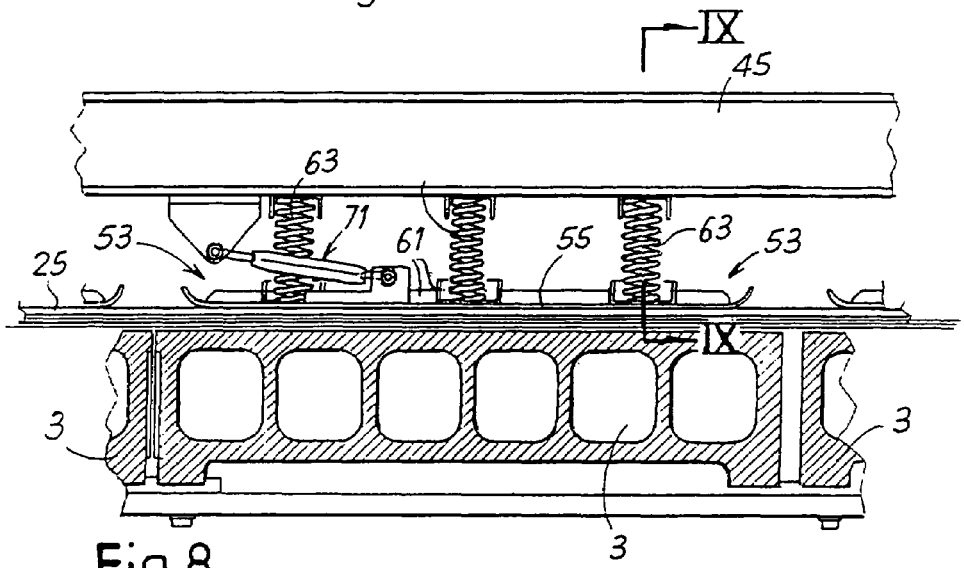

The pressure elements that press the cardboard against the heated plates 3 are constituted, in this example, by a series of pressure shoes 53 aligned in a longitudinal direction and each extending for the entire useful width of the device. Each shoe 53 comprises a plate 55 (see FIGS. 5, 7, 8) with edges orthogonal to the longitudinal direction shaped and curved upwards to prevent jamming against the underlying conveyor belt 25 against which they press and through which they exert pressure on the underlying corrugated cardboard. As can be seen in particular in FIG. 6 (where one shoe 53 is shown in a plan view), the plate 55 forming each shoe is perforated with elongated holes 57 disposed with their greater dimension parallel to the longitudinal direction F and aligned with one another according to a direction inclined in respect of the longitudinal direction and also in respect of the transverse direction. A second series of elongated holes 59 are disposed with their greater dimension parallel to the direction of alignment of the holes 57. The holes 57, 59 are disposed symmetrically on the shoe.

Figure 9:
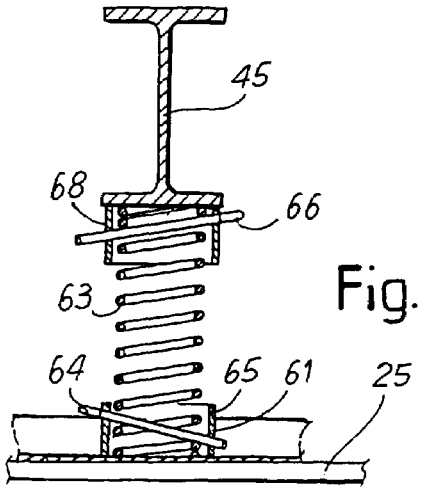
FIG. 9 is an enlarged cross-section according to IX-IX in FIG. 8.

Section bars 61 with a U-shaped cross-section are welded to the plate 55, at the level of which helical springs 63 are fastened, by means of split pins 64 (FIG. 9) which engage in holes produced in bushings 65 fastened to the section bars 61. The opposite end of each helical spring 61 is fastened to one or other of the fixed central longitudinal beams 45 or mobile lateral longitudinal beams 49, by means of split pins 66 engaging in holes produced in bushings 68 welded to the beams 45 or 49. More specifically, in the example shown, each shoe is fastened by three helical springs 63 to each of the six fixed beams 45 and of the three mobile beams 49 in the respective frame.

With this arrangement the following effect is obtained. On the conveyor belt 25 (and therefore on the cardboard pressed between the lower branch of it and the heated plates 3) pressure generated by the greater or lesser compression of the helical springs 63 is exerted. This compression is adjusted by raising and lowering the frames 41 by means of the piston-cylinder actuators 47. As four piston-cylinder actuators 47 are associated with each frame, it is easy to adjust the pressure profile along the entire extension of the hot section 5 of the device, adjusting the inclination of each frame in respect of the previous frame and the subsequent frame. For example, it is possible to obtain high and more or less constant pressure for the first length, corresponding to the first of the frames 41, and then a gradual reduction in pressure, positioning the first frame more or less horizontal and in the nearest possible position to the surface defined by the heated plates with consequent high compression of the helical springs 61. The successive frames will be inclined slightly upwards from upstream to downstream, to gradually reduce the pressure.

To prevent the frame 41 and the pressure shoes 53 from being drawn by friction with the conveyor belt 25 along the direction of feed F of the cardboard, the frame 41 furthest upstream is fastened to the fixed structure, also carrying the heated plates 3, by means of a pair of tie rods 67. Moreover (see FIGS. 6, 7, and 8), each pressure element constituted by the shoe 53 is fastened to the fixed longitudinal beams 45 by means of a toggle 69 disposed in a more or less central position and hinged to said fixed longitudinal beams 45. Moreover, each shoe is fastened to some of the fixed beams 45 and/or mobile beams 49 by means of tie rods 71. The toggle 69 also considerably reduces any transverse movement.

The flexibility of each plate 55 obtained by the slotted holes 57, 59 and the distribution of the elastic elements, constituted in this example by the helical springs 63, allows the pressure elements to adapt to the deformations of the upper surface of the heated plates 3, caused by thermal dilations. In this way controllable pressure throughout the entire contact surface of the cardboard with the heated plates is obtained.

As the width of the cardboard processed does not always correspond to the useful transverse dimension of the device, but is often narrower than this, in certain conditions the entire width of the heated plates 3 is not covered by cardboard, and there are two lateral bands in which the conveyor belt 25 is directly facing or in contact with the heated plates 3. If no specific measures are taken, this causes rapid wear of the device, due to the high temperature of the heated plates 3 and consequently overheating of the conveyor belt 25. To avoid or in any case reduce this drawback only some of the longitudinal beams associated with each frame are fixed in respect of the frame, while others (those in the outermost lateral positions, indicated with 49) are mobile in respect of the frame carrying them, by the piston-cylinder actuators 51. In this way, when the width of the cardboard to be processed is below the maximum width of the device, to prevent the lateral areas of the plates 55 from pressing the conveyor belt 25 directly against the upper surface of the hot plates 3 it is sufficient to raise a suitable number of mobile longitudinal beams 49 in respect of the relative frame, to release the springs 63 and essentially discharge the downward pressure exerted by the shoes along the lateral bands of the surface defined by the heated plates 3. In practice, the piston-cylinder actuators 51 operate in counter-pressure.

When it is necessary to eliminate compression stress of the shoe or pressure element 53 against the underlying mat or belt 25 and therefore essentially against the cardboard C, the ends of one or more of the mobile lateral beams 49 can be raised by the actuators 51 eliminating the compression action on the corresponding springs 63. Raising of the beams 49 continues until the springs 63 are extended, partly discharging the weight of the plates 55 forming the pressure elements 53 on them. In the areas in which they must not exert pressure on the underlying cardboard, they in fact "float", remaining on the one side suspended to the springs 63 and on the other sliding essentially weightlessly on the underlying mat or belt 25. In the central area, where the springs 63 are fastened to the fixed beams 45 and/or to the beams 49 that have not been raised, the plates 55 forming the pressure shoes or elements 53 continue to press with an appropriate pressure against the belt 25 and thus stress the cardboard C against the upper sliding surface of the heated plates 3. The plates 55 are therefore not flexurally deformed.

The number of mobile beams 49 is chosen in order to be able to reduce the work face, that is the width of the device on which pressure is exerted on the cardboard, to the minimum width of the cardboard to be processed by the system. Therefore, the number of mobile beams on each side of the frame (which in the example shown is equivalent to three), may vary as a function of the project parameters.

The device shown also has a further advantage that makes it possible to obtain even finer adjustment of the operating width of the device. In fact, in some operating conditions, each edge of the cardboard may be positioned more or less at the level of an alignment of springs 63, i.e. more or less at the level of one of the mobile beams 49. In these conditions, if the mobile beam at the level of the edge of the cardboard is not raised, at least a part of the plate 55 outside the edge of the cardboard will tend to come into contact with the underlying surface defined by the heated plates 3, making release of humidity from the cardboard difficult. On the other hand, if this beam is raised, the edge area of the cardboard will not be glued correctly, due to lack of the necessary pressure.

To prevent this drawback and allow more accurate adjustment and adaptation of the device to the width of the cardboard to be processed, the frame 41 is designed so that it can translate in a transverse direction, i.e. orthogonal to the direction F of feed of the cardboard, by half the distance between the two longitudinal beams 49. In this way in a condition of the type described hereinbefore, instead of raising two lateral beams at the level of the two edges of the cardboard, which could cause incorrect gluing, the frames move transversely and only one of the mobile longitudinal beams is raised, while the other remains lowered.

To obtain traverse movement of the frames, at least at the level of the transverse beam 43 furthest upstream of the first frame 41, a piston-cylinder actuator 81 (FIGS. 3, 4, 10, 11) is provided, with its rod hinged to an L-shaped bracket indicated with 83, oscillating around an axis B. The bracket 83 carries an idle wheel 85 that engages between two sides 87 integral with the beam 43 of the frame 41.

Oscillation between the two positions (shown respectively with a solid line and dashed line in FIG. 11) of the bracket 83 controlled by the actuator 81 consequently causes traverse of the first and consequently of all the frames 41. The tie rods 67 that hold the frames are fastened at their ends by ball joints 67A, 67B (FIG. 4) to allow traverse movement. It must be understood that traverse of the frame may also be obtained with a different mechanism and if necessary with greater accuracy. A higher number of mechanisms 81, 83, 85, 87 may also be provided, for example one at each end of each frame 41. In the example shown, with three frames 41 four mechanisms 81, 83, 85, 87 may for example be provided.

To make heating and consequently gluing more efficient, in the area upstream of the heated plates 3, where the various cardboard components are introduced, a roller is provided (FIG. 1 and FIG. 10) to pre-heat the smooth sheet N4. This roller, indicated with 88, is heated internally with steam or another heat-carrying fluid, which may be the same as the one used to heat the heated plates 3. The smooth sheet or liner N4 of the corrugated cardboard is introduced so as to be driven around the pre-heating roller 88.

As, depending on operating conditions, a larger or smaller range of contact of the cardboard with the pre-heating roller 88 may be required, a drive roller 89 is provided parallel to the pre-heating roller 88 carried at its ends by supports 93 integral with gear rings 91. By rotating the gear rings 91 the roller 89 may be made to take any position between two end positions shown with the dashed line and solid line in FIG. 10. As can be seen in this figure, the range of contact of the liner or smooth sheet N4 may consequently vary from a maximum upper value at 200° (when the roller 89 is in the positioned with dashed line in FIG. 10) to a minimum value at more or less 20-30° (roller 89 in the position with the solid line in FIG. 10). The maximum value will be used at the maximum production speeds. A variation in the range of contact may also be required as a function of the nature and thickness of the cardboard constituting the sheet N4.

It is understood that the drawing shows a simplification provided purely as a practical embodiment of the invention, the shapes and arrangements of which may vary without however departing from the scope of the concept underlying the invention. Any reference numbers in the claims hereunder are provided purely to facilitate reading in the light of the description hereinbefore and the appended drawings and do not limit the sphere of protection whatsoever.

What I claim is:

1. A device to join a sheet of smooth cardboard to a sheet of corrugated cardboard, the device comprising:

a series of heated plates aligned according to a longitudinal direction of feed of the cardboard and, above said heated plates, pressure elements to press the cardboard against said heated plates, which are connected by elastic elements to a supporting structure, wherein said supporting structure includes a plurality of frames aligned according to said longitudinal direction, and the inclination of said frames is adjustable to modify the pressure profile applied by said pressure elements to the cardboard, wherein adjacent frames are hinged together.

2. Device as claimed in claim 1, wherein the two ends of each frame, upstream and downstream in respect of the longitudinal direction of feed of the cardboard are vertically mobile.

3. Device as claimed in claim 2, wherein each of said frames includes at least two transverse beams and a longitudinal structure that joins together said transverse beams.

4. Device as claimed in claim 1, wherein each of said frames includes at least two transverse beams and a longitudinal structure that joins together said transverse beams.

5. Device as claimed in claim 4, wherein each longitudinal structure of each frame has a plurality of central longitudinal beams, which extend essentially according to said longitudinal direction of feed of the cardboard and are positioned side by side in a transverse direction, connected by said at least two transverse beams.

6. Device as claimed in claim 5, wherein each of said frames carries a mobile longitudinal beam on each side.

7. Device as claimed in claim 6, including a plurality of mobile longitudinal beams on each side of each frame.

8. Device as claimed in claim 5, wherein each of said pressure elements includes a plate fastened by at least one of said elastic elements to at least one of said central longitudinal beams and/or said mobile longitudinal beams.

9. Device as claimed in claim 8, wherein said elastic element includes a helical spring.

10. Device as claimed in claim 5, wherein said frame supports at least a mobile longitudinal beam which is movable with respect to the frame and arranged and designed to be raisable in respect of said frame, each of said pressure elements being connected to each of said central longitudinal beams and to each of said mobile longitudinal beams of a respective frame via said elastic elements.

11. Device as claimed in claim 5, wherein said frames have a transverse movement equivalent to half the distance between two adjacent longitudinal beams.

12. Device as claimed in claim 5, wherein each of said pressure elements is fastened to at least one of said beams by a retaining element that prevents it from being conveyed along the longitudinal direction of feed of the cardboard.

13. Device as claimed in claim 5, wherein each of said pressure elements is fastened to at least one of said beams by means of a lever that prevents translation in a transverse direction and in a longitudinal direction.

14. Device as claimed in claim 1, wherein each of said frames includes at least two transverse beams and a longitudinal structure that joins together said transverse beams.

15. Device as claimed in claim 1, wherein said frame supports at least a mobile longitudinal beam which is movable in respect of the frame and arranged and designed to be raisable in respect of said frame.

16. Device as claimed in claim 1, wherein each of said pressure elements extends transversely to the longitudinal direction of feed for the entire operating width of the device.

17. Device as claimed in claim 1, wherein said frames are provided with an adjustment movement in a transverse direction to the longitudinal direction of feed of the cardboard.

18. Device as claimed in claim 17, wherein the frame furthest upstream in respect of the direction of feed of the cardboard, is connected to a fixed structure by tie rods and ball joints that allow transverse translation of said frame.

19. Device as claimed in claim 17, wherein an actuator is associated with at least one of said frames, to control transverse adjustment movement of the frames.

20. Device as claimed in claim 1, wherein four vertical actuators are associated with each of said frames to control a raising and lowering movement of the frame.

21. Device as claimed in claim 1, wherein each of said pressure elements includes a plate with an essentially flat active portion.

22. Device as claimed in claim 21, wherein said active portion of said pressure element has a plurality of openings.

23. Device as claimed in claim 22, wherein said openings have an elongated shape.

24. Device as claimed in claim 23, wherein some of said openings are disposed with their greater dimension parallel to the longitudinal direction of feed of the cardboard.

25. Device as claimed in claim 24, wherein the openings disposed with their greater dimension parallel to the longitudinal direction of feed of the cardboard are distributed according to alignments inclined in respect of the longitudinal direction of feed of the cardboard and in respect of the transverse direction.

26. Device as claimed in claim 25, wherein said alignments are parallel to said inclined directions.

27. Device as claimed in claim 23, wherein some of said openings are disposed with their greater dimension oriented in inclined directions in respect of the longitudinal direction of feed of the cardboard and in respect of the transverse direction.

28. Device as claimed in claim 27, wherein U-shaped section bars are rigidly fastened to said essentially flat active portion of each pressure element, said section bars being oriented according to said inclined directions.

29. Device as claimed in claim 23, wherein said openings are disposed according to a symmetrical distribution on the pressure element.

30. Device as claimed in claim 21, wherein U-shaped section bars are rigidly fastened to said essentially flat active portion of each pressure element.

31. Device as claimed in claim 30, wherein said elastic elements connect the pressure element to said longitudinal beams, said elastic elements being are fastened at a location corresponding to said section bars.

32. Device as claimed in claim 1, including a pre-heating roller for at least one component of the cardboard.

33. Device as claimed in claim 32, wherein a drive roller is associated with said pre-heating roller and is parallel to the pre-heating roller, the axis of which may adopt an adjustable position around the axis of the pre-heating roller.

34. Device as claimed in claim 1, wherein a conveyor belt is disposed between said pressure element and the cardboard.

35. Device as claimed in claim 34, wherein the conveyor belt is driven around a roller upstream, in the cardboard feed area, which may be raised in respect of the trajectory of the cardboard.

36. A device to join a sheet of smooth cardboard to a sheet of corrugated cardboard, the device comprising:

a plurality of heated plates arranged along a longitudinal direction of feed of the cardboard;

a supporting structure located at a position above said heated plates;

a plurality of pressure elements fastened to said supporting structure for pressing the cardboard against said heated plates, said pressure elements defining a work face of a width adjustable as a function of the width of the cardboard, wherein said supporting structure is provided with a traverse movement in an essentially orthogonal direction to the longitudinal direction of feed of the cardboard, each pressure element having a transverse dimension equal to a maximum transverse dimension of the cardboard, each pressure element being fastened at a plurality of points along its transverse dimension to said supporting structure.

37. Device as claimed in claim 36, wherein said pressure elements are fastened to said supporting structure so as to be able to reduce or eliminate in selected lateral areas the pressure with which they act on the underlying cardboard.

38. Device as claimed in claim 36, wherein each of said pressure elements is fastened to the supporting structure by elastic elements.

39. Device as claimed in claim 38, wherein the supporting structure includes mobile fastening points for at least some of said elastic elements and wherein by moving said fastening points with respect to the supporting structure at least some of said elastic elements may be drawn to eliminate or reduce the pressure exerted by said pressure elements in selected lateral areas.

40. A device to join a sheet of smooth cardboard to a sheet of corrugated cardboard, the device comprising:

a plurality of heated plates aligned according to a longitudinal direction of feed of the cardboard;

a supporting structure, said supporting structure including a plurality of frames aligned along said longitudinal direction;

a plurality of elastic elements;

a plurality of pressure elements positioned above said plurality of heated plates to press the cardboard against said heated plates, each pressure element being connected to said supporting structure via said elastic elements, wherein the inclination of said frames is adjustable to modify the pressure profile applied by said pressure elements to the cardboard, wherein each of said pressure elements extends transversely to the longitudinal direction of feed for the entire operating width of the device.

41. Device as claimed in claim 40, wherein each of said pressure elements includes a plate with an essentially flat active portion.

42. A device to join a sheet of smooth cardboard to a sheet of corrugated cardboard, the device comprising:

a plurality of heated plates aligned according to a longitudinal direction of feed of the cardboard;

a supporting structure, said supporting structure including a plurality of frames aligned along said longitudinal direction;

a plurality of elastic elements;

a plurality of pressure elements positioned above said plurality of heated plates to press the cardboard against said heated plates, each pressure element being connected to said supporting structure via said elastic elements, wherein the inclination of said frames is adjustable to modify the pressure profile applied by said pressure elements to the cardboard, wherein four vertical actuators are associated with each of said frames to control a raising and lowering movement of the frame.

43. Device as claimed in claim 42, wherein each of said pressure elements includes a plate with an essentially active portion.

* * * * *